United States Patent [19]

Holz et al.

[11] Patent Number: 4,595,919

[45] Date of Patent: Jun. 17, 1986

[54] SYSTEM AND METHOD FOR OPERATING A DISPLAY PANEL HAVING MEMORY

[75] Inventors: George E. Holz, North Plainfield; James A. Ogle, Neshanic Station, both of N.J.

[73] Assignee: Burroughs Corporation, Detroit, Mich.

[21] Appl. No.: 525,282

[22] Filed: Aug. 22, 1983

[51] Int. Cl.[4] ..... G09G 3/00

[52] U.S. Cl. ..... 340/793; 340/714; 340/758; 340/776; 340/805; 315/169.1

[58] Field of Search ..... 340/714, 758, 776, 793, 340/805, 813; 315/169.1, 169.2, 169.3

[56] References Cited

U.S. PATENT DOCUMENTS

| | | | |
|---|---|---|---|
| 3,919,591 | 11/1975 | Criscimagna | 340/776 |
| 4,067,047 | 1/1978 | Ryan | 340/805 |
| 4,329,616 | 5/1982 | Holz et al. | 340/714 |
| 4,373,157 | 2/1983 | Holz et al. | 340/805 |
| 4,385,293 | 5/1983 | Wisnieff | 340/793 |
| 4,386,348 | 5/1983 | Holz et al. | 340/714 |
| 4,414,544 | 11/1983 | Suste | 340/793 |

*Primary Examiner*—Gerald L. Brigance
*Assistant Examiner*—Jeffery A. Brier
*Attorney, Agent, or Firm*—Robert A. Green; Mark T. Starr; Kevin R. Peterson

[57] ABSTRACT

A display panel comprising a matrix of D.C. scan cells arrayed in rows and columns and a matrix of A.C. display cells arrayed in rows and columns, each scan cell being in operative relation with at least one display cell. The panel also includes a sustainer electrode associated with the display cells and operated by means of specially shaped sustaining signals to select and turn on desired display cells as the columns of scan cells are energized in turn. Disclosed are various routines for oprating the sustainer electrode to achieve dimming in the panel and for maintaining proper display of a message in the panel.

7 Claims, 10 Drawing Figures

SYSTEM AND METHOD FOR OPERATING A DISPLAY PANEL HAVING MEMORY

BACKGROUND OF THE INVENTION

A new type of display panel having memory is described in U.S. Pat. No. 4,386,348 of George E. Holz and James A. Ogle. The panel comprises a gas-filled envelope including a layer of D.C. scan/address cells and a layer of quasi A.C. display cells. The scan cells are arrayed in rows and columns, and the display cells are arrayed in corresponding rows and columns. The scan cells are scanned and turned on column-by-column by operation of their electrodes while sustain signals are simultaneously being applied to the display cells, and the same electrodes are used to transfer information from selected scan cells to the associated display cells where glow is sustained by the sustainer signals. The cells which are energized in the entire panel, by this routine, display a stationary but changeable message.

It is desirable, for some applications, to be able to dim a panel of the type described above, and dimming can be achieved by lowering the frequency of the sustainer signals. However, if this is done, the writing of new information at the lower sustainer frequency may be slow and flicker may occur.

DESCRIPTION OF THE INVENTION

The present invention comprises an electronic system used with a display panel of the type described and claimed in U.S. Pat. No. 4,386,348 of George E. Holz and James A. Ogle, this application being incorporated herein by reference.

Figure 1:
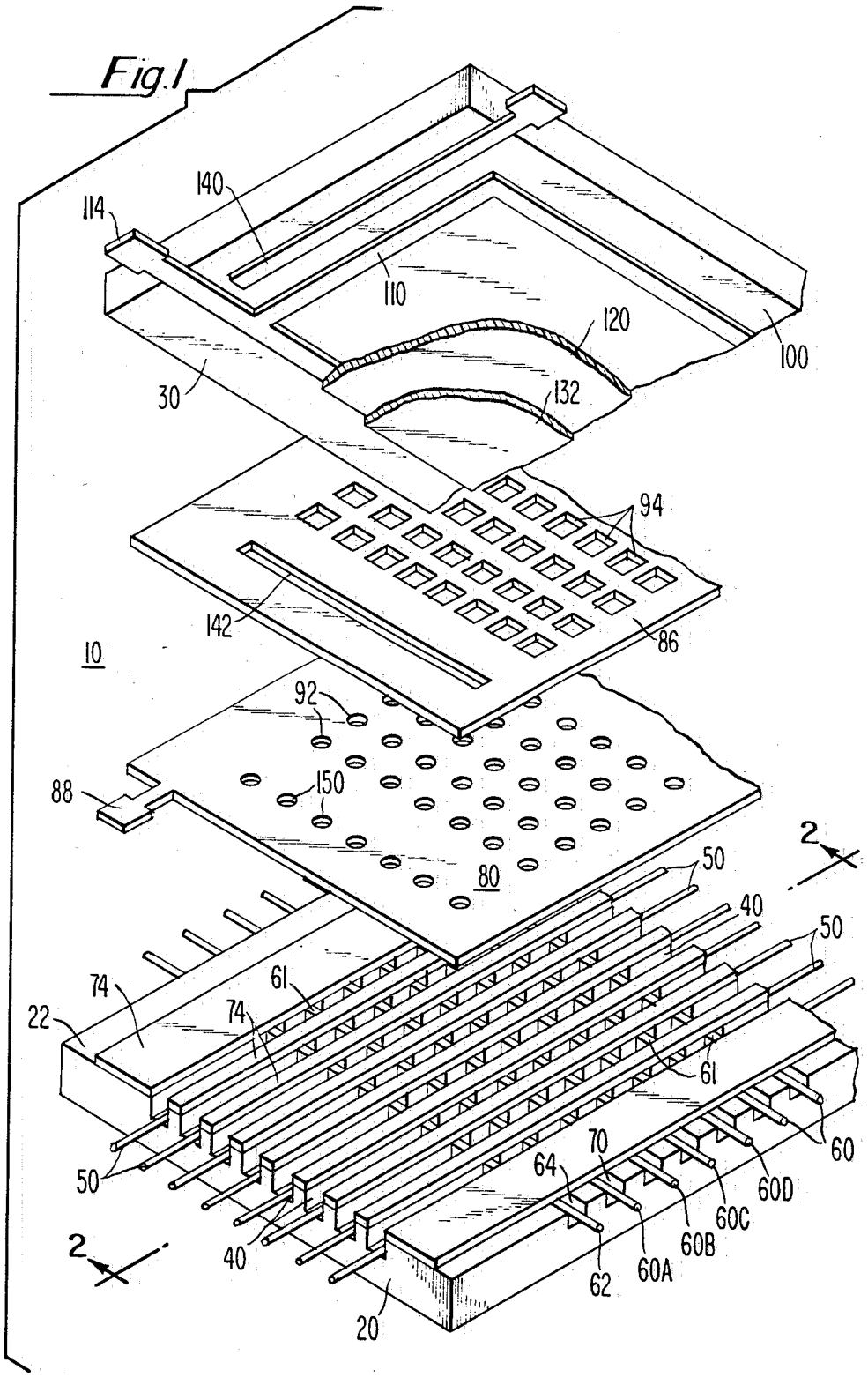
FIG. 1 is a perspective exploded view of a display panel operated according to the invention.

This display panel 10, shown in the drawings, comprises a gas-filled envelope made up of an insulating base plate 20 and a glass face plate 30, which is shown tilted up and to the left in FIG. 1 to present a view of its inner surface. These plates are hermetically sealed together along their aligned perimeters to provide an envelope which encloses the various gas-filled cells and operating electrodes of the panel. The base plate has a top surface 22 in which a plurality of deep parallel slots 40 are formed and in each of which a scan/address wire anode electrode 50 is seated and secured.

Figure 2:
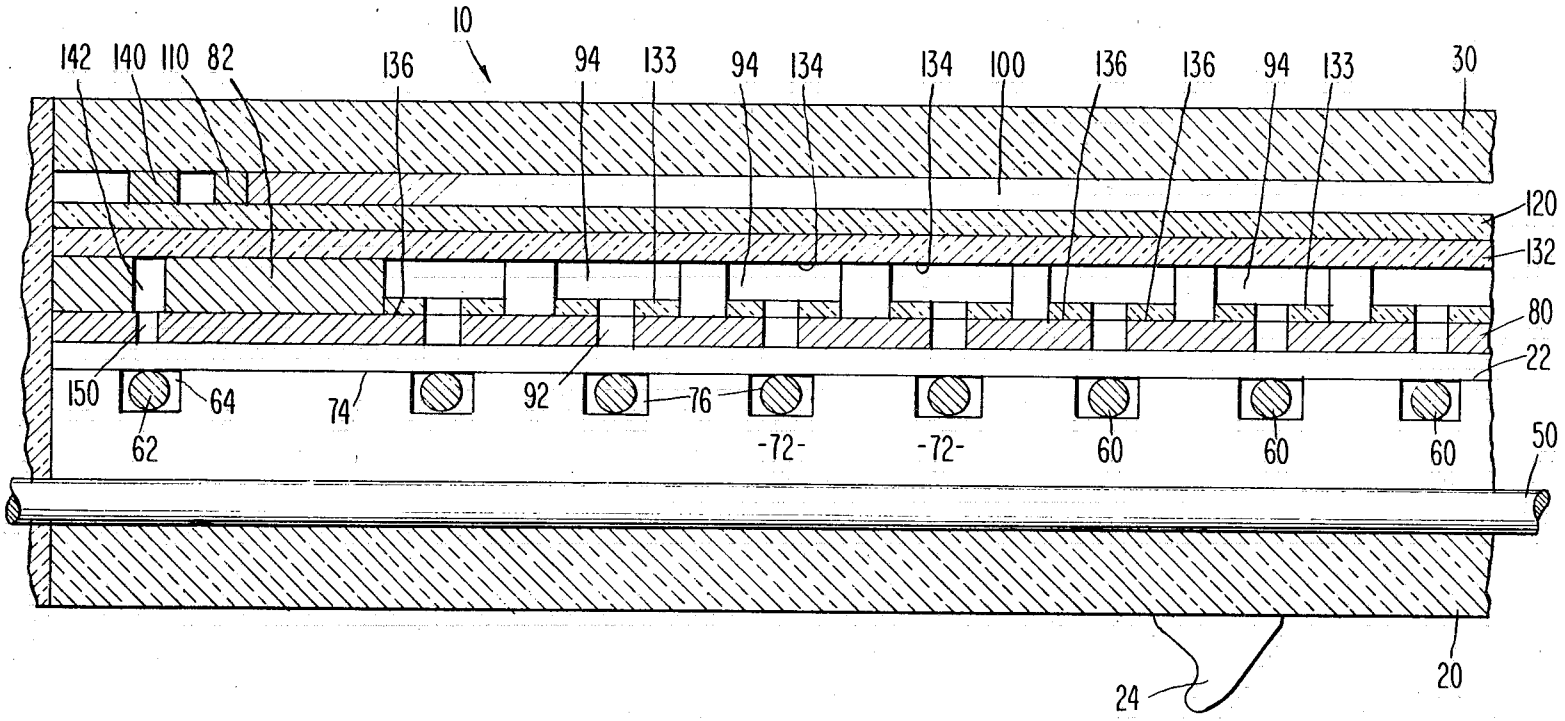
FIG. 2 is a sectional view along lines 2—2 in FIG. 1, with the panel shown assembled.

A plurality of scan cathode electrodes 60 are seated on the top surface of the base plate or in shallow grooves 70 therein. The grooves 70 and scan cathodes 60 are disposed transverse to the grooves 40 and scan anodes 50, and each crossing of a scan cathode 60 and scan anode 50 defines a scanning cell 72 (FIG. 2). It can be seen that the anodes 50 and cathodes 60 form a matrix of scanning cells which are arrayed in rows and columns. More specifically, the cathode portions 61, the underlying portions of anodes 50, and the intermediate gas volumes define the scanning cells.

The scan cathodes 60A, B, C, etc., form a series of cathodes which can be energized serially in a scanning cycle, with cathode 60A being the first cathode energized in the scanning cycle.

A reset cathode strip 62 is disposed on the base plate or in a groove 64 therein adjacent to the first scan cathode 60A, so that, when it is energized, it provides excited particles for cathode 60A at the beginning of a scanning cycle to be described. Where the reset cathode crosses each scan anode 50, a reset cell is formed, and the crossing of all of the scan anodes by the reset cathode provides a column of reset cells. These reset cells are turned on or energized at the beginning of each scanning cycle, and they expedite the turn-on of the first column of scanning cells associated with cathode 60A.

The panel 10 includes a keep-alive arrangement which is described below and in U.S. Pat. No. 4,329,616 of George E. Holz and James A. Ogle, which is incorporated herein by reference.

In the panel 10, a spacer means comprising strips 74 of insulating material, such as glass, are provided on the top surface of the insulating plate 20 between slots 40 and crossing cathodes 60 and 62 so that the cathodes are spaced uniformly from an electrode plate 80 (known as the priming plate) disposed above them, as described below. The strips 74 are disposed across the cathodes 60 which are thus separated into the discrete operating portions 61.

The portions of the panel described up to this point comprise the base plate assembly. This is the D.C. portion and the scanning and addressing portion of the panel 10 in which the electrodes are in contact with the gas in the panel.

Adjacent to the base plate assembly is the second portion of the panel which is a quasi A.C. assembly; that is, it includes electrodes which are insulated from the gas in the panel, and electrodes which are in contact with the gas. This portion of the panel includes electrode 80 which is in the form of the thin metal plate having an array of rows and columns of relatively small apertures 92, each overlying one of the scanning cells. The plate 80 is positioned close to cathodes 60 and may be seated on insulating strips 74. Plate 80 is known as a priming plate.

Adjacent to plate 80, and preferably in contact with the upper surface thereof, is an apertured plate 86 (known as the glow isolator) having rows and columns of apertures 94 which are larger than apertures 92. The apertures 94 comprise the display cells of panel 10. The sheet 86 may be of insulating material, or it may be of metal, and, if it is of metal, the plates 80 and 86 may be made in one piece. Plate 80 is provided with a tab 88 to which external electrical contact can be made.

The quasi A.C. assembly also includes a face plate assembly which includes a single large-area transparent conductive electrode 100 on the inner surface of the plate 30. A narrow conductor 110, which outlines and reinforces the electrode layer 100 in conductive contact, serves to increase its conductivity, if necessary. The conductor 110 includes a suitable tab 114, to which external connection can be made. The large-area electrode 100 is of sufficient area to overlie the entire array of display cells 94 in plate 86. An insulating coating 120 of glass or the like covers electrode 100, and this layer 120 is coated with a low work function refractory layer 132 of magnesium oxide, thorium oxide, or the like.

In panel 10, the apertures 94 in plate 86 comprise display cells, and, as can be seen in FIG. 2, each display cell has one end wall 134 formed by a portion of insulating layer 132, and an opposite end wall 136 formed by a portion of the top surface of plate 80. To provide cell uniformity and to minimize sputtering, a coating of the material of layer 132 should also be provided on the base or lower wall 136 of each display cell 94, such as the layer 133 shown in FIG. 2.

At the present time, it appears that optimum operation of the panel is achieved if the apertures or cells 94 are unsymmetrical in that insulating layers 120 and 132 together have a thickness greater than layer 133. Indeed, layer 133 may even be thinner than layer 132. Thus, the lower end wall 132 of each cell 94 will have a very high capacitance coupling to the cell, and layer 133 will consequently tend to form only a minimal wall charge in the operation described below. In one mode of construction, both layer 132 and layer 133 may be formed by an evaporation process, and layer 133 may be so thin that it is not completely continuous, which is a desirable quality. In any case, however, the character of this wall of the cell is affected by the aperture 92 in the metal plate 80.

The gas filling in panel 10 is preferably a Penning gas mixture of, for example, neon and a small percentage of xenon, at a pressure of about 400 Torr. When the panel has been constructed and evacuated, the gas filling is introduced through a tubulation 24 secured to base plate 20 (FIG. 2), or a non-tubulated construction can be employed.

The keep-alive arrangement, in panel 10, includes an A.C. electrode 140 in the form of a line-like conductive film or layer of an opaque metal, such as silver, provided on the inner surface of the face plate 30 adjacent to one edge of the transparent conductive electrode 100. The A.C. keep-alive electrode 140 is positioned so that, in the completed panel, it overlies the column of reset cells and reset cathode 62, to which it supplies excited particles. The A.C. keep-alive electrode 140 is covered by the insulating layers 120 and 132. In this keep-alive arrangement, the plate 86 is provided with a slot 142, and plate 80 is provided with a column of holes 150. The slot 142 overlies and is aligned with the column of holes 150, and both lie beneath and are aligned with the A.C. electrode 140 so that, in effect, the electrode 140, slot 142 and holes 150 form a sandwich. The slot 142 in the plate 86 is narrower than the opaque A.C. electrode 140 so that a viewer, looking through face plate 30, cannot see any glow which is present in slot 142 and holes 150. Electrode 140 operates with plate 80 to produce glow discharge between them and produce excited particles in slot 142 and holes 150. These excited particles are available to the reset cathode 62 and assist the firing of the column of reset cells.

Systems for operating panel 10 are described in U.S. Pat. No. 4,386,348 and in U.S. Pat. No. 4,315,259, of Joseph E. McKee and James Y. Lee, which is also incorporated herein by reference. Some of the principles of these systems are useful in the system described below.

Figure 3:
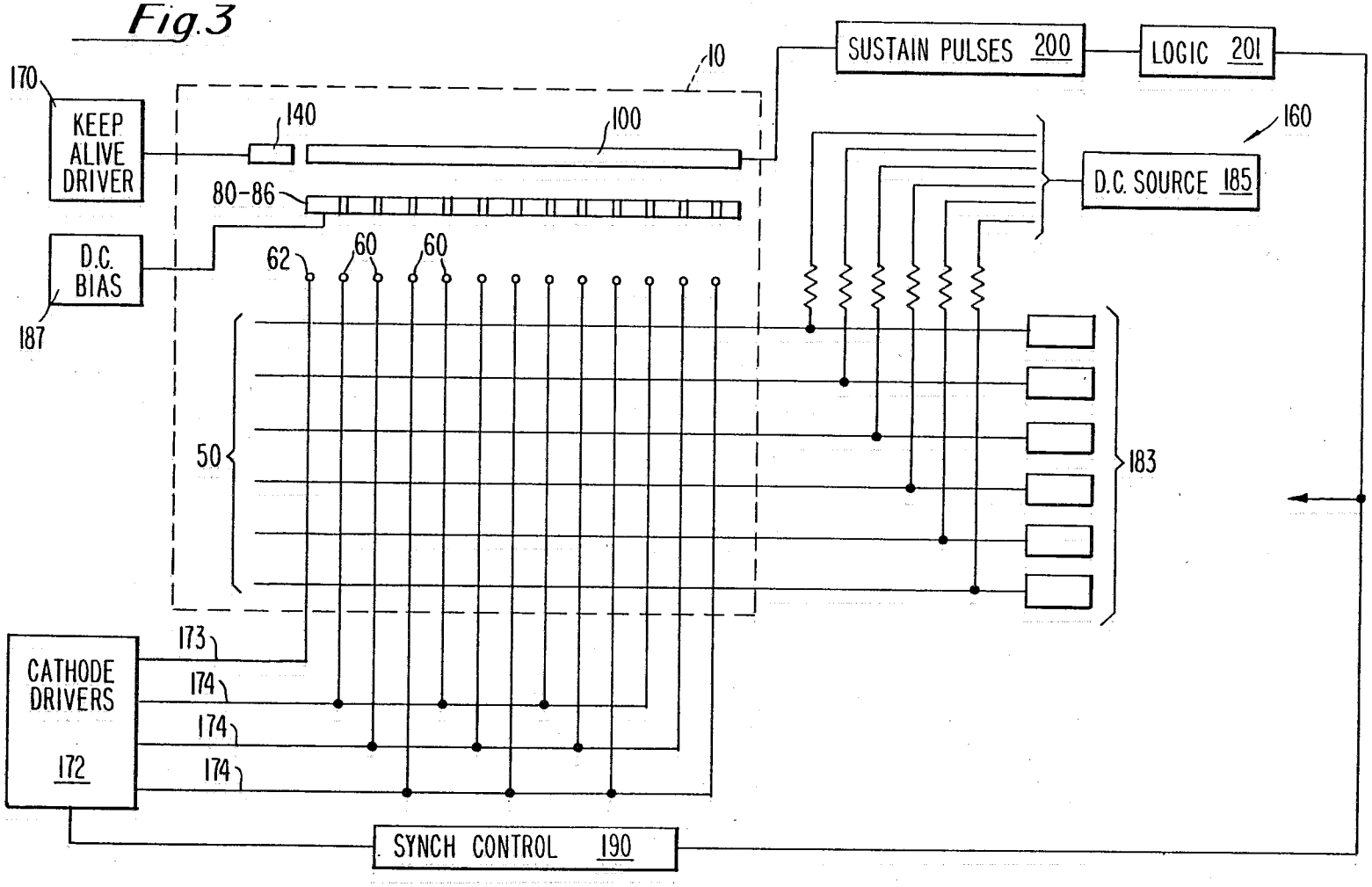
FIG. 3 is a schematic showing of the panel of FIG. 1 and an electronic drive system therefor.

A schematic representation of the display panel 10 and an electronic system 160, according to the invention, for operating the panel are shown in FIG. 3. The circuit includes a keep-alive driver 170, which provides an A.C. signal, suitably coupled to keep-alive electrode 140. The system also includes module 172 which comprises a series of serially energizable drivers for providing a negative reset pulse for reset cathode 62 on lead 173 and a series of negative scan cathode pulses for cathodes 60 on leads 174. The scan cathodes 60 are connected in groups or phases, with each group including any suitable number of cathodes such as three or four or six, or more, as desired. Grouping of cathodes in this way is now well known in the SELF-SCAN panel art. The scan phase drivers in module 172 are sequentially activated so as to energize each of the cathodes 60 in consecutive sequence along the "X" axis of the panel.

A D.C. power source 185 is coupled through a resistive path to each of the scan anodes 50. In addition, separate data drivers 183, each of which represents a source of write pulses and erase pulses, are coupled, one to each scan/address anode 50.

A source 187 of D.C. bias potential is coupled to priming plate 80, and a source 200 of A.C. sustainer signals, is connected to the transparent conductive layer 100.

Suitable timing and synchronising circuits 190 are provided as required.

The operation of display panel 10, as described in the above-identified application, is generally as follows. With the keep-alive mechanism energized by source 170 and generating excited particles, and with operating potential applied to the scan anodes 50 from source 185, the reset cathode 62 is energized to fire the column of reset cells, and then the scan cathodes 60 are energized sequentially by operation of driver module 172 to carry out a scanning operation in the D.C. scan portion and scan cells 72 of the panel 10. At the same time, with A.C. sustaining pulses applied from source 200 to the electrode 100, as each column of scan cells is energized, negative write or display pulses are applied from one or more selected driver modules 183, in accordance with input data and with proper timing with respect to the sustaining pulses, to the selected scan anodes.

Under these conditions, if the data or address signals from a source 183 direct that a particular display cell be turned on, when the column containing the scan cell beneath that display cell is being scanned, that scan cell is momentarily turned off, in synchronism with, and during, the application of a positive sustainer pulse to the electrode 100, and the cell is then turned back on, so that the scanning operation can proceed normally. During the period when this scan cell is turned off, and its discharge is in the process of decaying, a positive column is drawn to electrode 80 and electron current flows from its electrode portion 61 to electrode 80, and electrons are drawn through the aperture 92 in electrode 80 into the selected display cell 94 by the positive sustainer pulse. This combination of effects, with some current multiplication probably occurring in the display cell, produces a negative wall charge on wall 134 of the selected display cell, and the combination of the voltage produced by this wall charge and the voltage of the next negative sustainer pulse produces a glow discharge in the selected display cell. This discharge, in turn, produces a positive wall charge on wall 134, which combines with the next positive sustainer pulse to produce a glow discharge, and, in similar manner, successive sustainer pulses produce successive dicharges and consequent visible glow in the selected cell.

After all cell columns have been scanned and the desired display cells have been turned on, the sustainer pulses keep these cells lit and the written message displayed.

The erasing operation is generally similar to the writing operation described above. In erasing, as in writing, the selected display cell is operated upon while its underlying scan cell is being scanned, but the erase signal is applied in synchronism with, but following, the negative sustainer pulse. For the erase operation, the associated scan cell is again turned off momentarily, and then it is turned back on, to avoid interfering with the normal column-by-column scan of the scan cells. While it is off, the decaying discharge around electrode portion 61 again produces electron flow to electrode 80, and through the aperture in that electrode into the display cell. This serves to remove, or neutralize, the positive charge then on wall 134 of the display cell (which charge was produced by the most recent negative sustainer pulse) so that the next sustainer pulse will fail to produce a glow discharge, and glow discharge, or display, in the selected cell will cease.

Figure 4:
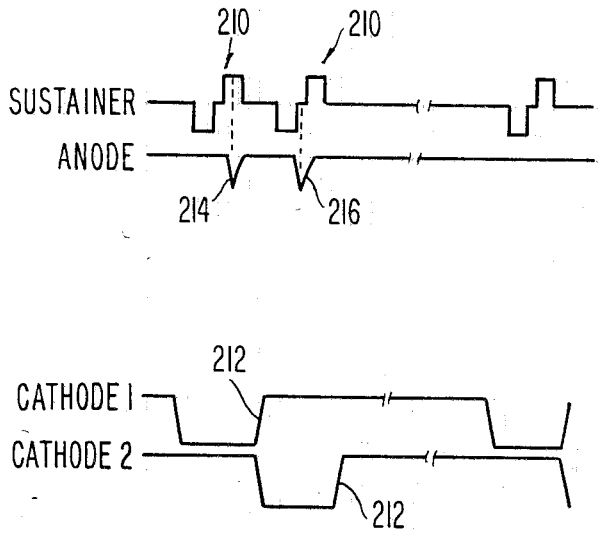
FIG. 4 shown some waveforms used in operation of the system of the invention.
Figure 6:
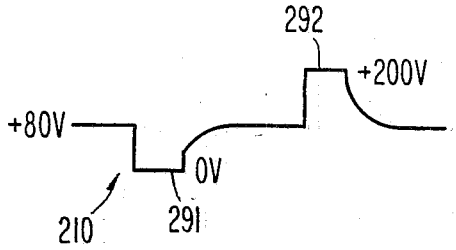
FIG. 6 shows one form of sustainer waveform generated by the circuit of FIG. 5.
Figure 5:
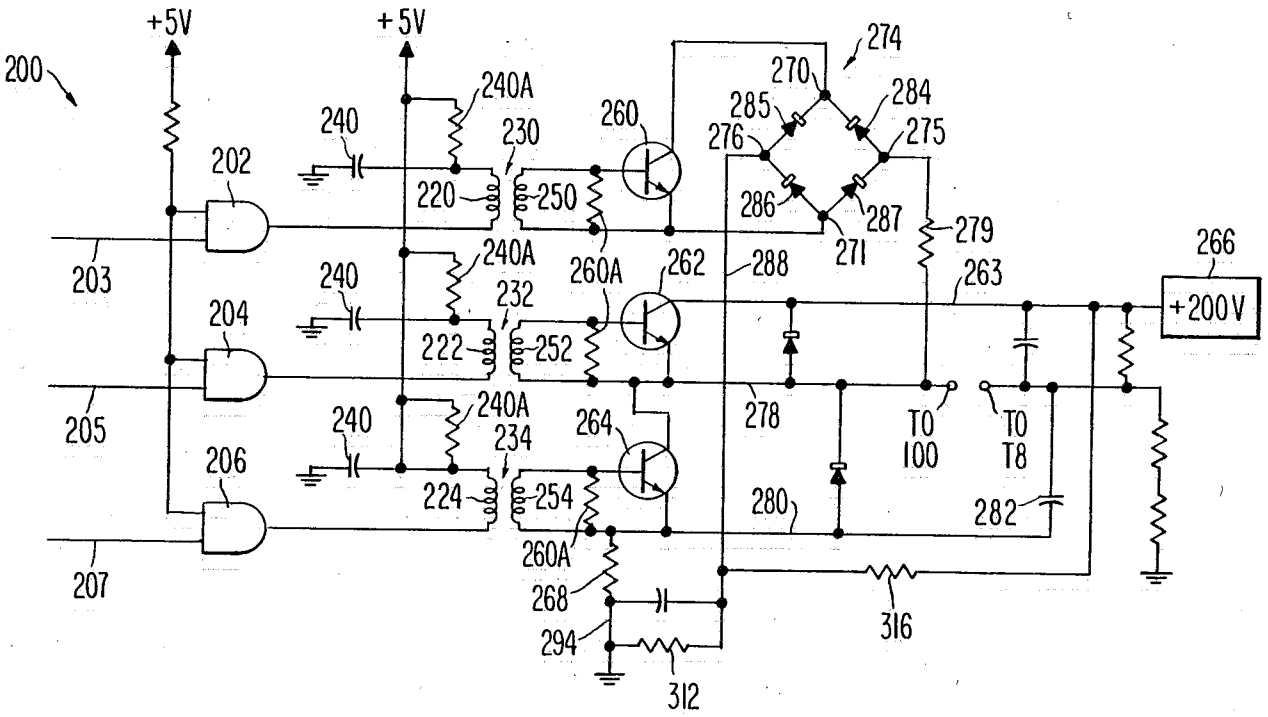
FIG. 5 is a circuit for generating sustainer waveforms used in the invention.

A logic circuit 201 is coupled to sustainer pulse generator 200 for performing the operations described below:

FIG. 4 shows some of the waveforms used in carrying out the foregoing operation. These waveforms include sustainer pulses 210, write and erase pulses 192 and 194, respectively, and their relationship to the sustainer pulses, and the turn-on signals 196 applied to two successive cathodes in a scanning cycle. A circuit such as that shown in FIG. 5 can be used to provide the sustainer signals 210 (FIG. 6) and other sustainer signals to be described. The circuit is shown in the above cited U.S. Pat. No. 4,315,259 of McKee and Lee. In operation of this circuit, the turn-on pulses for the circuit 200 are controlled by appropriate logic in source 201 to obtain the desired frequency and wave shape.

To generate sustainer pulses, control circuit 190 operates logic circuit 201 to first apply a turn-on pulse to AND gate 206, the output of which, operating through transformer 234, turns on transistor 264. Transformer 234 performs signal level shifting and provides base current to turn on transistor 264 and a low base impedance to assist in the turn-off of transistor 264. The turn-on of transistor 264 generates the negative-going pulse 291 (FIG. 6) at lead 278 which reaches a level of about zero volts.

After the desired time duration for pulse 291, AND gate 202 receives a turn-on pulse which operates through transformer 230, like transformer 234, to turn on transistor 260, and this generates current flow through the diode bridge 274 to return the sustaining pulse to the 80 volt level. Next, AND gate 204 receives a turn-on pulse, and its output turns on transistor 262 which generates the positive pulse 292 of the sustaining signal to a level of about 200 volts. Finally, AND gate 202 receives another pulse to turn on transistor 260 again to generate the negative-going portion of the sustaining signal back to the 80 volts level by way of the diode bridge 274.

It is noted that transistor 260 performs a dual function in switching the sustaining signal either from 200 volts to the reference level of 80 volts or from zero volts to the reference level of 80 volts. The positive or negative transition of the switching operation of transistor 260 is determined by the sustain output voltage level prior to switching and the resultant path through the diode bridge 274. If the sustain output level is at 200 volts, the turn-on of transistor 260 will cause the sustain output to switch in a negative direction to 80 volts due to the low impedance path to the 80 volt bus 288 by way of resistors 279, diode 284, transistor 260, and diode 286. Diodes 285 and 287 are open circuited. Likewise, if the sustain output level is at zero volts, the turn-on of the transistor 260 will cause the sustain level to switch in a positive direction along a low impedance path to the 80 volt bus 388 by way of resistor 279, diode 287, transistor 260, and diode 285, with diodes 284 and 286 being open circuited.

Those skilled in the art will see that circuit 200 can be readily operated as required to provide the sustainer pulses to be described below.

Figure 7A:
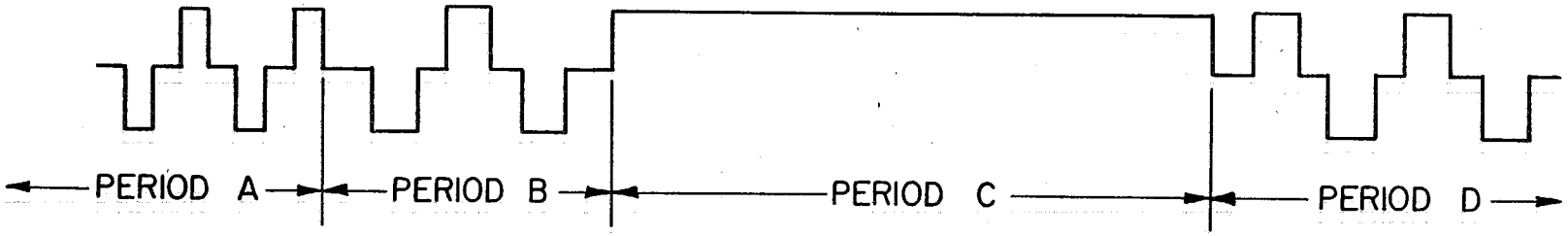
FIGS. 7A and 7B show two sustainer waveforms used in the invention.

In order to achieve dimming in panel 10, several modes of operation can be utilized with different degrees of effectiveness. In one mode, the sustainer waveform shown in FIG. 7A is used, whether or not there is information in the panel when the dimming operation is begun. Assume that the sustainer frequency for providing "normal" brightness is being applied to the panel, and this is represented by the sustainer signal frequency shown in time period A in FIG. 7A. This frequency of the sustainer is reduced to the desired lower sustainer frequency for a period of time, period B, and then, only a steady positive sustainer potential is applied to the entire panel during period C to permit cells to be addressed and information to be set into the panel. During this time period C, the columns of scan cells are cycled through and selected display cells are addressed and written, this operation being carried out at high speed of the order of 10 milliseconds or less to minimize flicker. At the end of this time and in period D, the desired low frequency of sustainer signals as in period B is reapplied and maintained for as long as desired to retain the message which had been set into the panel during period C at the desired level of brightness which is lower than that in period A.

Figure 7B:
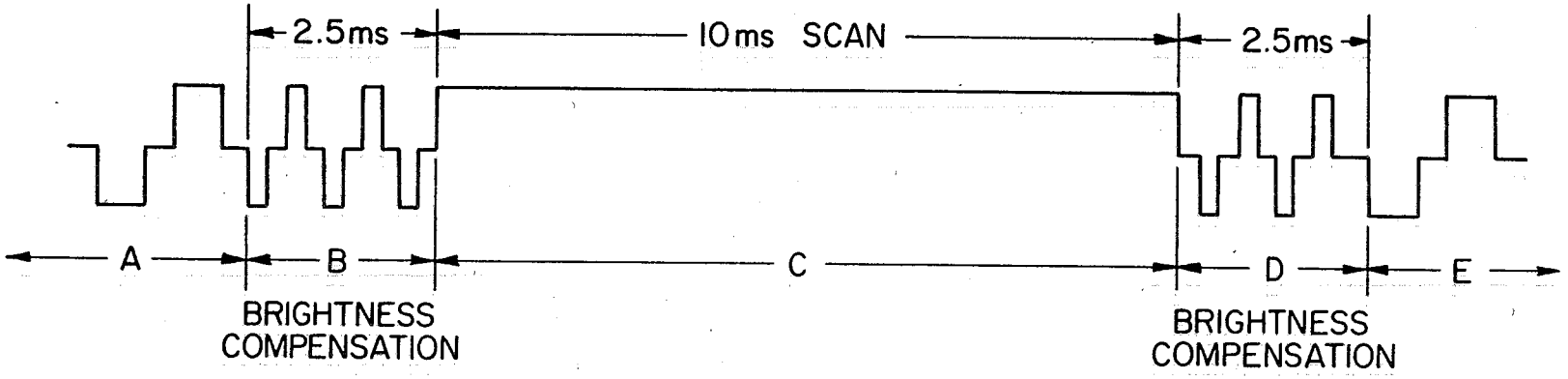

In another mode of operation, which reduces any undesirable flicker which may appear in the foregoing method, the sustainer waveform shown in FIG. 7B is used. In this mode of operation, periods of brightness compensation are included both before and after the period during which information is written into the panel. Thus, the waveform of FIG. 7B includes a period A of the desired low sustainer frequency, to achieve a dimmed message, followed by a period B of higher sustainer frequency. Period B is followed by the addressing period C, in which a constant positive sustainer signal is applied and the desired cells are addressed. After period C, there is another period D of higher sustainer frequency like period B, and finally period E, during which the lower sustainer frequency of period A is applied and the message entered in period C is sustained in the panel. In one system of operation, periods B and D were 2.5 ms in length, and the sustainer frequency was three times that in periods A and E. Again period C was 10 ms long.

By suitably altering the frequencies of the sustaining signals in time periods B and D, and by suitably altering the duration of these periods before and after the write period C, the desired average brightness of the viewed panel can be achieved. A wide range of panel brightnesses is possible.

Referring to the operation of FIG. 7B, if the total time duration of the scan plus compensation intervals B, C and D is kept below about 15 milliseconds, no flicker in display brightness is apparent during updating of information, even with random update recurrence intervals.

In a modification of the method described above with respect to FIG. 7B, a period of brightness compensation (like period B) may be inserted before write period C or after write period C, or having a small portion before and after write period C. The particular routine can be readily determined by those skilled in the art.

In any of these methods where brightness compensation is employed as in FIG. 7B, the number of compensation sustainer pulses in time periods B and D should be approximately equal for optimum flicker suppression. The specific frequency in period B need not be identical to that of period D although in most systems it will be. For proper operation, the brightness compensation periods must provide very nearly the total number of sustainer pulses which would have occurred during periods B, C, and D at the basic display frequency of periods A and E.

In operation, it is practical to accommodate panel and system idiosyncracies by adjusting the duration or frequency of the sustainer signals until the flicker is invisible.

As is well known in the art, the behavior of gas discharge display panels cannot always be predicted, and, in addition, it is difficult to achieve complete uniformity of characteristics from panel to panel. Thus, with operating systems of the type described above, in some panels, some of the display cells which are selected and turned on during the addressing period C (FIGS. 7A and 7B) may not be re-ionized reliably after the 10 ms off time of the scan time slot C. The apparent effect is the loss of some display points following each such scan period. The reason for these re-ignition failures is that a cell which fires very late in a sustain pulse has less opportunity to accumulate wall charge before the sustain signal returns to its center level, after which the already small wall charge is depleted, thus effectively erasing the cell. Another way of viewing this result is that a late firing is similar in effect to a very short sustain pulse, which in itself is a classical method of erasing ON cells.

Figure 8:
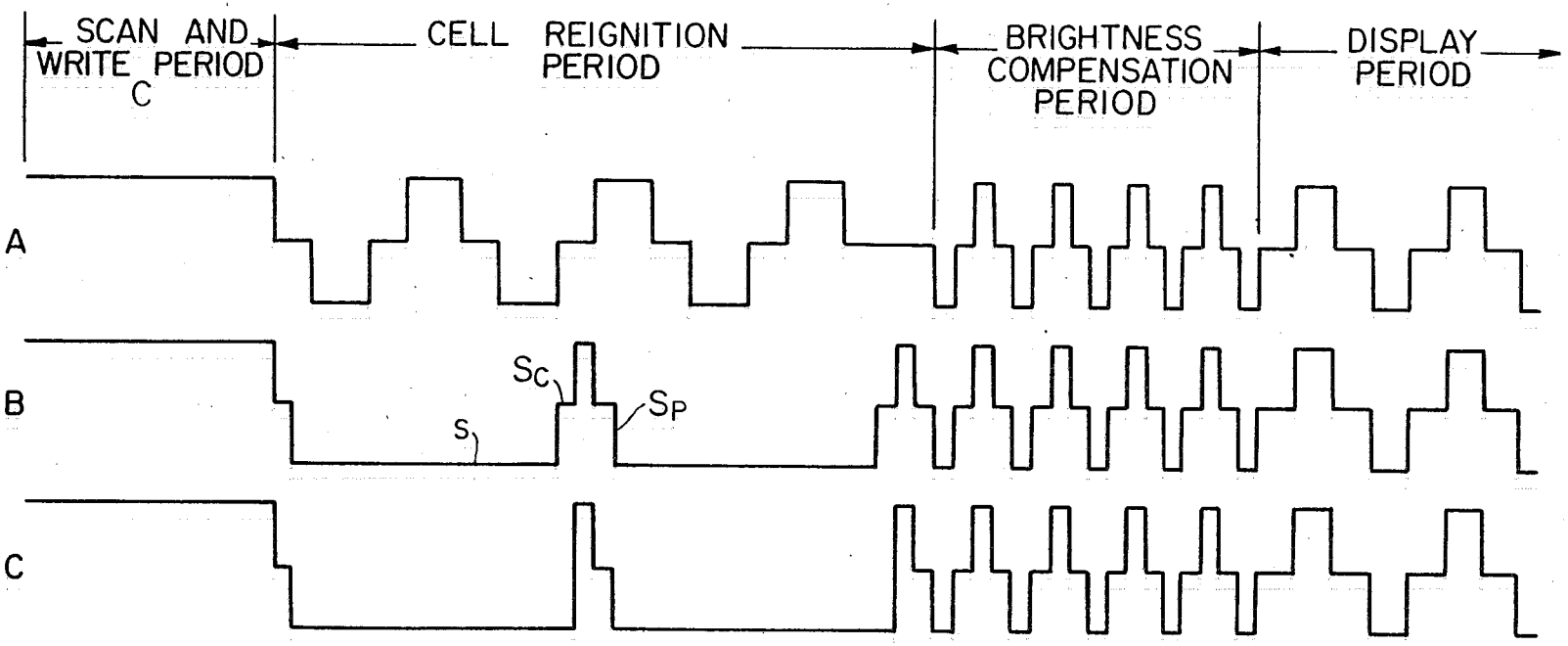
FIGS. 8 and 9 show other sustainer waveforms used in the invention.

A solution for this problem, referring to FIG. 8, comprises providing an additional time period, known as a cell re-ignition time slot, after period C, during which steady positive sustainer potential is applied and a message is written into the panel.

In FIG. 8, one effective sustainer waveform A includes a period of "normal" sustainer signals in a cell re-ignition time slot between the scan and address or write time period C and the brightness compensation period (B and D in FIG. 7B). This is not an optimum solution to the problem, and improvement is obtained by the waveform B shown in FIG. 8, which includes, in the cell re-ignition time slot, a steady negative sustainer signal S following the scan period C and having one sustainer pulse SP, from negative to positive to negative, in about the middle of the period.

The waveform for the cell re-ignition time slot which appears to be optimum at the present time is waveform C shown in FIG. 8 and is similar to that of waveform B; however, elimination of the return-to-center portion Sc of the waveform B following the critical first sustaining pickup half cycles eliminated the remaining problems. A possible explanation for this result is that a cell that fires very late in the sustain pulse is refired in the opposite polarity by the adjacent opposing pulse and accumulates sufficient wall charge during this second firing to remain in an ON state.

One may also, if desired, introduce compensation periods within the write time slot C, provided the address scanning is appropriately managed so that all cells are addressed, e.g., by a dimming during the compensation periods or by scanning in reverse during half of the compensation time. In effect, this treats the register as though it were two or more registers, each shorter, the flash or blink being thus more easily masked. Re-ignition routines may be required after each period during which display has been suspended, depending on the length of the scan period.

Figure 9:
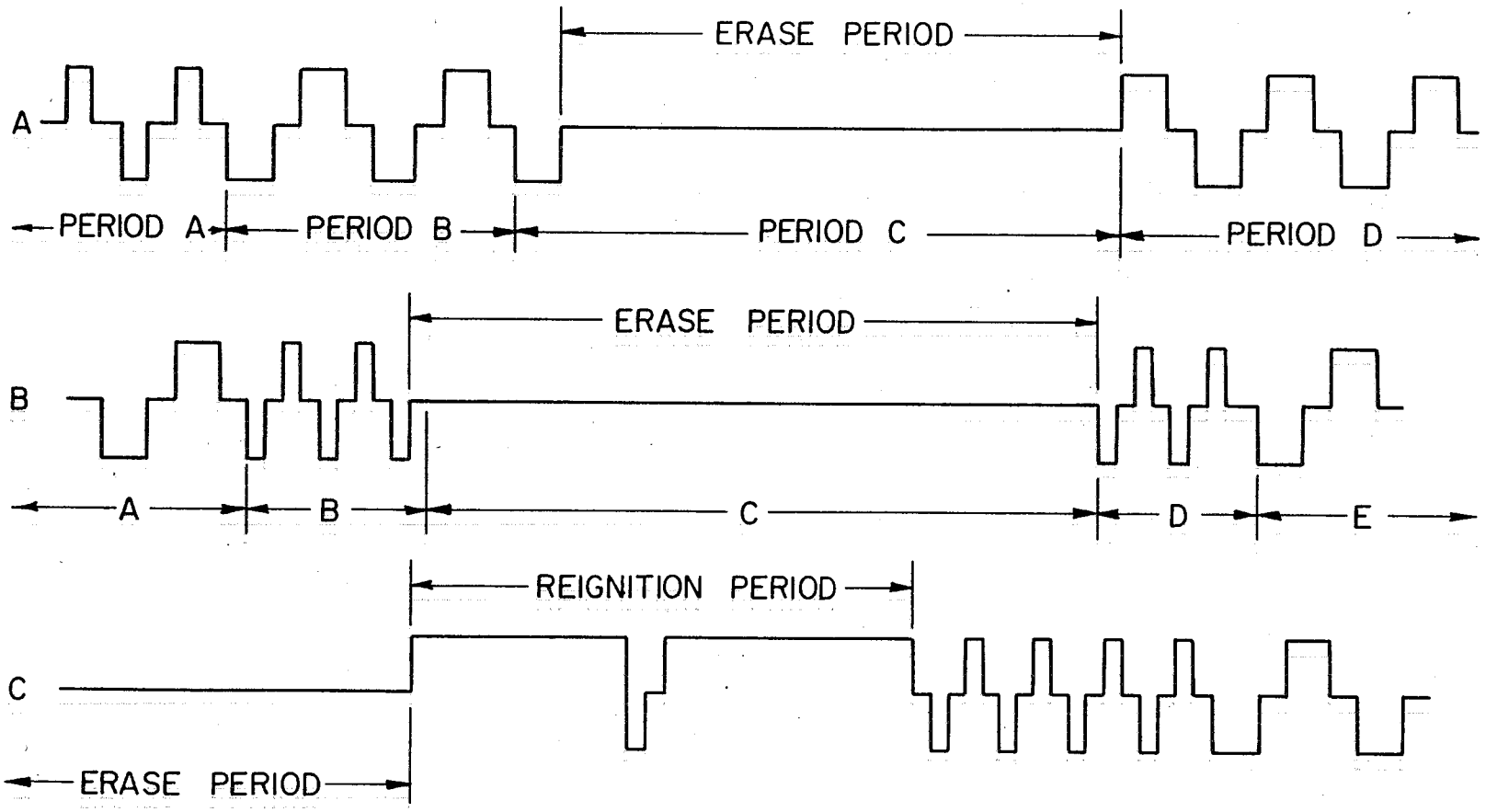

If the data logic required the circuit to erase cells during the scan periods (in FIGS. 7A, 7B, and 8), the corresponding waveforms A, B, and C shown in FIG. 9 would be used. Waveform A is comparable to the waveform of FIG. 7A and has the sustainer signal at the reference level during period C and a negative pulse at the end of period B, just before period C begins. During period C, selected cells would be erased rather than written.

Waveform B is identical to the waveform of FIG. 7B except that the sustainer signal is at reference level during period C.

Waveform C is comparable to waveform C of FIG. 8 except that the sustainer is at reference level during period C and, during the re-ignition period, it goes to a positive level, with the auxiliary pulse being a negative-going pulse.

What is claimed is:

1. A system for operating a display panel with memory wherein the display panel includes a gas-filled envelope, a first layer of D.C. scan cells disposed in rows and columns and including row scan anodes and column scan cathodes which cross each other, with the crossings defining said D.C. cells, an apertured electrode defining rows and columns of display cells, each display cell being in communication with a D.C. scan cell, and an A.C. electrode associated with and insulated from said apertured electrode and operating therewith as the electrodes for said display cells, said system comprising first means coupled to all of said scan anodes for applying operating potential thereto, second means coupled to said scan cathodes for applying operating potential to each cathode in turn to fire and turn on each column of scan cells in turn sequentially, third means coupled to said scan anodes for applying data signals to selected ones of said anodes as its column of scan cells is fired and turned on, fourth means coupled to said apertured electrode and said A.C. electrode for applying sustainer signals thereto, the application of said sustainer signals and said data signals being synchronized so that, when the data signals are applied, glow is generated in the selected display cells associated with the scan anodes to which the data signals are applied, the sustainer signals sustaining the display glow in such selected display cells, and control means coupled to said fourth means for modifying said sustainer signals to include (1) a period of second sustainer signals which are at a lower frequency than that of said sustainer signals which reduces the brightness of any display cells which are "on" and glowing, (2) a period in which the sustainer signals are at a constant positive level and, during this period, the columns of scan cells are scanned sequentially and data signals are applied to turn on selected associated display cells, and (3) a remainder period during which the sustainer signals are at said lower frequency.

2. A system for operating a display panel with memory wherein the display panel includes a gas-filled envelope, a first layer of D.C. scan cells disposed in rows and columns and including row scan anodes and column scan cathodes which cross each other, with the crossings defining said D.C. cells, an apertured electrode defining rows and columns of display cells, each display cell being in communication with a D.C. scan cell, and an A.C. electrode associated with and insulated from said apertured electrode and operating therewith as the electrodes for said display cells, said system comprising first means coupled to all of said scan anodes for applying operating potential thereto, second means coupled to said scan cathodes for applying operating potential to each cathode in turn to fire and turn on each column of scan cells in turn sequentially, third means coupled to said scan anodes for applying data signals to selected ones of said anodes as its column of scan cells is fired and turned on, fourth means coupled to said apertured electrode and said A.C. electrode for applying sustainer signals thereto, the application of said sustainer signals and said data signals being synchronized so that, when the data signals are applied, glow is generated in the selected display cells associated with the scan anodes to which the data signals are applied, the sustainer signals sustaining the display glow in such selected display cells, and control means coupled to said fourth means for modifying the sustainer signals applied to said A.C. electrode to permit the panel to perform various functions, said control means modifying said sustainer signal to include (1) a period of a first frequency for providing a selected brightness of said display cells, (2) a period of higher frequency, (3) a period during which the sustainer signal is at a constant positive level and information can be written into the panel, (4) a period of said higher frequency, and (5) a remainder period of said first frequency.

3. The system defined in claim 2 wherein said (2) and (4) periods are of shorter duration than said (3) period.

4. The system defined in claim 2 wherein said control means modifies said sustainer signal to include a re-ignition time slot after said period during which a write operation is performed to thereby insure turn-on of all cells which are supposed to be displayed.

5. The system defined in claim 4 wherein, in said re-ignition time slot, a positive sustainer pulse is inserted.

6. The system defined in claim 4 wherein, in said re-ignition time slot, a pulse is inserted which rises directly from a negative level to a positive level and then falls to reference level for a short period and then falls to a negative level.

7. A system for operating a display panel with memory wherein the display panel includes:

a gas-filled envelope, a first layer of D.C. scan cells disposed in rows and columns and including row scan anodes and column scan cathodes which cross each other, with the crossings defining said D.C. cells, an apertured electrode defining rows and columns of display cells, each display cell being in communication with a D.C. scan cell, and an A.C. electrode associated with and insulated from said apertured electrode and operating therewith as the electrodes for said display cells, said system comprising:

first means coupled to all of said scan anodes for applying operating potential thereto, second means coupled to said scan cathodes for applying operating potential to each cathode in turn to fire and turn on each column of scan cells in turn sequentially, third means coupled to said scan anodes for applying data signals to selected ones of said anodes as its column of scan cells is fired and turned on, fourth means coupled to said apertured electrode and said A.C. electrode for applying sustainer signals thereto, the application of said sustainer signals and said data signals being synchronized so that, when the data signals are applied, glow is generated in the selected display cells associated with the scan anodes to which the data signals are applied, the sustainer signals sustaining the display glow in such selected display cells, and control means coupled to said fourth means for modifying the sustainer signals applied to said A.C. electrode to permit the panel to perform various functions, said control means modifying said sustainer signal to include (1) a period of a first frequency for providing said glow at a selected brightness of said display cells, (2) a period of a desired lower frequency which dims the glow and the light output from the panel, (3) a period during which the sustainer signal is set at a constant reference level following a negative sustainer pulse for performing an erase operation, and (4) a remainder period during which said sustainer signal is at said desired lower frequency.

* * * * *